US009500108B2

(12) United States Patent
Brown

(10) Patent No.: US 9,500,108 B2
(45) Date of Patent: Nov. 22, 2016

(54) SPLIT PATH SILENCER

(71) Applicant: William Robert Brown, Ann Arbor, MI (US)

(72) Inventor: William Robert Brown, Ann Arbor, MI (US)

(73) Assignee: Flexible Metal, Inc., Tucker, GA (US)

( * ) Notice: Subject to any disclaimer, the term of this patent is extended or adjusted under 35 U.S.C. 154(b) by 0 days.

(21) Appl. No.: 14/593,213

(22) Filed: Jan. 9, 2015

(65) Prior Publication Data

US 2016/0201530 A1 Jul. 14, 2016

(51) Int. Cl.
*F01N 1/12* (2006.01)
*F01N 1/24* (2006.01)
*F01N 1/08* (2006.01)

(52) U.S. Cl.
CPC ..... *F01N 1/24* (2013.01)

(58) Field of Classification Search
CPC ..... F01N 1/12; F01N 1/125; F01N 1/08; F01N 1/086
USPC ..... 181/280, 251, 253, 257, 268, 274, 275, 181/279, 281, 232
See application file for complete search history.

(56) References Cited

U.S. PATENT DOCUMENTS 1,236,987 A * 8/1917 Schmitt ..... F01N 1/06 181/253
1,505,893 A * 8/1924 Hunter ..... F01N 1/12 165/135
1,612,584 A * 12/1926 Hunter ..... F01N 1/12 181/279
1,782,396 A * 11/1930 Aaron ..... F01N 1/12 181/280
1,797,310 A * 3/1931 Wright ..... F01N 1/12 181/280
1,957,012 A * 5/1934 Hayncs ..... F01N 1/12 181/281

(Continued)

*Primary Examiner* — Edgardo San Martin
(74) *Attorney, Agent, or Firm* — Varnum, Riddering, Schmidt & Howlett LLP

(57) ABSTRACT

A silencer having an outer shell with a first opening at a first end is configured with two flow paths and designed to attenuate sound waves. A tube is positioned within the outer shell, the tube having a first end and a second end forming a path through the interior of the silencer. A baffle is positioned between the inner tube and the outer shell to form a second path through the silencer. The first path may be longer than the second path. The sum of the cross-sectional areas of the first path and second path may be equal to the cross-sectional area of the first opening.

24 Claims, 6 Drawing Sheets

(56) References Cited

U.S. PATENT DOCUMENTS 2,185,489 A 7/1935 Wilman
2,031,451 A * 2/1936 Austin ..... F01N 1/06 181/241
2,063,270 A * 12/1936 Bacchetti-Righetti .... F01N 1/12 181/280
2,108,671 A * 2/1938 Kato ..... F01N 1/084 181/265
2,359,365 A * 10/1944 Katcher ..... F01N 1/12 181/280
2,911,055 A * 11/1959 McDonald ..... F01N 1/12 181/280
3,113,635 A * 12/1963 Allen ..... F01N 1/06 181/252
3,132,717 A * 5/1964 Baruch ..... F01N 1/125 181/256
3,235,003 A * 2/1966 Smith ..... F01N 1/125 138/38
3,580,357 A 5/1971 Whitney
3,648,802 A 3/1972 Pierce
3,746,126 A * 7/1973 de Cardenas ..... F01N 1/12 138/37
3,805,495 A * 4/1974 Steel ..... B01D 45/16 131/209
3,888,331 A 6/1975 Wang
3,913,703 A * 10/1975 Parker ..... F01N 1/12 181/206
3,948,349 A 4/1976 Bychinsky
3,963,092 A 6/1976 Soares
4,050,539 A 9/1977 Kashiwara
4,317,502 A * 3/1982 Harris ..... F01N 1/12 181/280
4,683,978 A 8/1987 Venter
4,792,014 A * 12/1988 Shin-Seng ..... F01N 13/082 181/227
6,554,100 B2 * 4/2003 Kim ..... F01N 1/006 181/277
7,117,973 B2 10/2006 Graefenstein
7,380,635 B2 6/2008 Harris
7,484,590 B2 2/2009 Jeon
7,661,509 B2 2/2010 Dadd
8,312,962 B2 * 11/2012 Melcher ..... F01N 1/081 181/212

* cited by examiner

SPLIT PATH SILENCER

FIELD OF INVENTION

The present invention generally relates to an apparatus and method for dampening and suppressing acoustical resonance within a pipe that conducts sound waves between a sound source and a second location.

BACKGROUND

Unwanted acoustic noise is a problem that plagues many mechanical systems, specifically in automobiles, as well as other systems. For example, automotive exhaust systems and charged air coolers often suffer from undesired noise or turbo whine. The unwanted noise can produce both sound pollution, and in some cases, harmful vibrations.

Some existing devices attempt to attenuate such unwanted noise by inserting a device in-line with the duct system. However, existing devices currently suffer from various drawbacks and deficiencies. First, some devices are bulky and occupy a large physical volume. This causes design problems, specifically in automotive engines, as constraints under an automobile hood or within an engine compartment can be very tight. Additionally, the large volume required by existing products is caused by dimension requirements for attenuated increased levels of sound. In other words, reducing the size of such devices will also decrease the sound attenuation that they provide.

Accordingly, a silencer that is able to provide greater degree of sound attenuation over a wider frequency range while occupying a smaller physical volume than current silencing technologies is needed.

SUMMARY

A silencer includes an outer shell having a first opening at a first end. A tube is positioned within the outer shell, the tube having a first end and a second end forming a path through the interior of the silencer. A baffle is positioned between the inner tube and the outer shell to form a second path through the silencer. The sum of the cross-sectional areas of the first path and second path may be equal to the cross-sectional area of the first opening.

In an embodiment, the cross-sectional area of the first path and the second path may be equal. The cross-sectional areas of the first path and the second path may be equal to half of the area of the first opening.

In an embodiment, the baffle may be a helical baffle spirally wound about the inner tube. The helical baffle may form the second path.

In an embodiment, the silencer may include more than one baffle spirally wound around the inner tube to form. The baffles may form a plurality of secondary paths through the silencer. The sum of the cross-sectional area of all of the secondary paths and the first path may be equal to the area of the first opening.

In an embodiment, the silencer may include one or more baffles, such as helical baffles, positioned within the inner tube. The silencer may include a baffle within the inner tube and without a baffle wound about the inner tube, or may include both a baffle within the inner tube and wound around the inner tube. The sum of the cross-sectional areas of the paths through the inner tube and the secondary paths outside of the inner tube may be equal to the cross-sectional area of the first opening.

BRIEF DESCRIPTION OF THE DRAWINGS

The operation of the invention may be better understood by reference to the detailed description taken in connection with the following illustrations, wherein.

DETAILED DESCRIPTION

Figure 1:
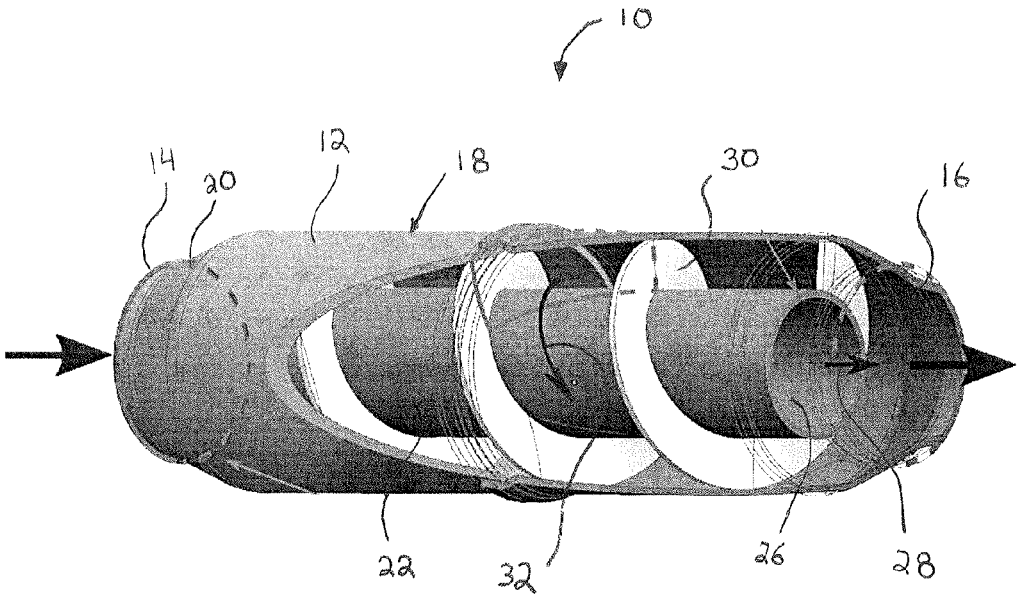
FIG. 1 illustrates a partial cut-away view of a split path silencer.
Figure 2:
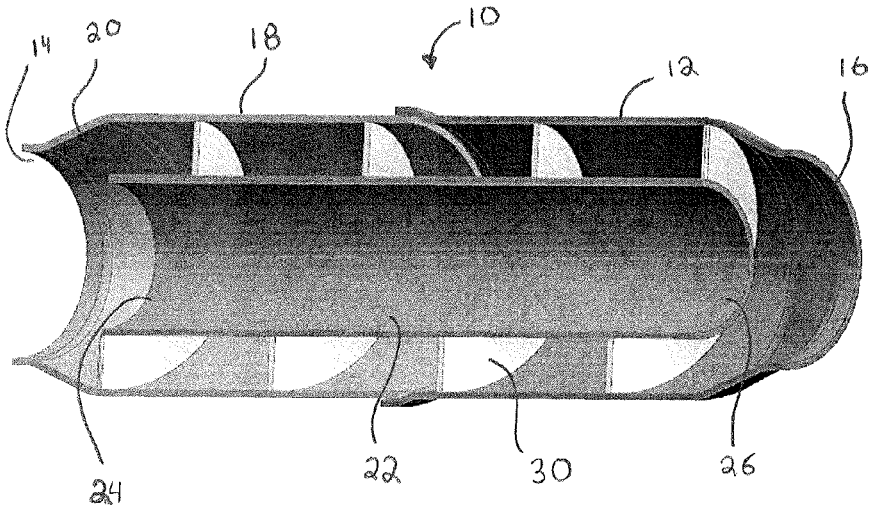
FIG. 2 illustrates a full cut-away view of a split path silencer.

Reference will now be made in detail to exemplary embodiments of the present invention, examples of which are illustrated in the accompanying drawings. It is to be understood that other embodiments may be utilized and structural and functional changes may be made without departing from the respective scope of the invention. Moreover, features of the various embodiments may be combined or altered without departing from the scope of the invention. As such, the following description is presented by way of illustration only and should not limit in any way the various alternatives and modifications that may be made to the illustrated embodiments and still be within the spirit and scope of the invention.

A silencer 10 is generally presented. The silencer 10 may be a split path silencer, as generally described herein. The silencer 10 is specifically designed to suppress and muffle unwanted noise within a ducted system, such as an automotive exhaust system or turbo engine charged air cooler. Further, the silencer 10 may be configured to minimize its volume footprint while maximizing the degree and frequency range of sound attenuation that it provides.

The silencer 10 may be configured to connect to a duct or pipe that outputs or conveys sound waves. For example, the silencer 10 may be connected in line within an automobile engine exhaust system to muffle and attenuate the sound.

The silencer 10 includes an outer shell 12. The outer shell 12 may be a pipe or duct having any appropriate shape, such as a generally cylindrical shape with a circular cross-section. The outer shell 12 may be hollow to surround a volume and any internal components of the silencer 10. The outer shell may be formed out of any appropriate material, such as any formable metal.

The outer shell 12 may include a first opening 14 located at a first end of the silencer 10, and a second opening 16 located at a second end of the silencer 10. The first opening 14 may be an inlet to connect to an opening of another duct or pipe and receive sound waves into the silencer 10 from the other duct or pipe. The second opening 16 may be an output to emit the attenuated sound waves, if any, from the silencer 10. The second opening 16 may be connected to another pipe or duct or may be open to the atmosphere.

In an embodiment, the outer shell 12 may include an expanded section 18. The expanded section 18 may be located along any appropriate position along the silencer, such as near the middle of the outer shell 12. The expanded section 18 may be larger in cross-sectional area than one or both of the first and second openings 14, 16. For example, the outer shell 12 may be generally cylindrically shaped having circular first and second openings 14, 16. The diameter of the cross-section of the expanded section 18 may be greater than the diameter of the first opening 14 and/or the second opening 16. The expanded section 18 may be spaced a distance away from the first and second openings 14, 16. The outer shell 12 may include ramped sections 20 between the expanded section 18 and the openings 14, 16.

In an embodiment, the outer shell 12 may be formed by two or more components. For example, a first component may include the first opening 14 and a portion of the expanded section 18. A second component may include the second opening 16 and a portion of the expanded section 18. The two components may be joined together using a friction or compression joint, a weld seam, or by any other appropriate means.

The silencer 10 may include an inner tube 22 positioned within the outer shell 12. The inner tube 22 may be any appropriate shape, such as cylindrical, and may include a first opening 24 and a second opening 26. The first opening 24 of the inner tube 22 may be positioned proximate to, but a distance away from, the first opening 14 of the outer shell 12. Likewise, the second opening 26 may be positioned proximate to, but a distance away from, the second opening 16 of the outer shell 12. The inner tube 22 may form a first path for sound waves to travel through the silencer 10, as illustrated by the straight arrow 28 in FIG. 1. The inner tube 22 may be solid, other than its openings 24, 26, to isolate the volume within the tube from the remaining volume within the outer shell 12 and create an uninterrupted path for sound to travel through the silencer 10.

In an embodiment, the inner tube 22 may be specifically sized to be approximately the same length as the length of the expanded section 18. The inner tube 22 may be positioned to be aligned with the expanded section 18 such that a center point of the inner tube 22 is aligned with a center point of the expanded section 18 along the length of the silencer 10. The inner tube 22 may be positioned to be concentric with the outer shell 12, such that the inner tube 22 and outer shell 12 share a central axis.

The silencer 10 may include a baffle 30 positioned within the outer shell 12. The baffle 30 may be any appropriate shape, such as generally helical. The baffle may be positioned between the inner tube 22 and the outer shell 12 to form a second path within the silencer 10. The arrow 32 in FIG. 1 illustrates the second path for sound waves to travel within the silencer 10.

The baffle 30 may be solid and continuous along its length to isolate the second path from the first path and the remaining volume within the outer shell 12. The baffle 30 may extend from the inner tube 22 to the outer shell 12 to completely isolate the second path 32. The spiral baffle 30 may allow for an opening at the beginning and the end of the second path 32 in order to receive sound waves and for sound waves to rejoin with other sound waves traveling through the first path 28.

Figure 4:
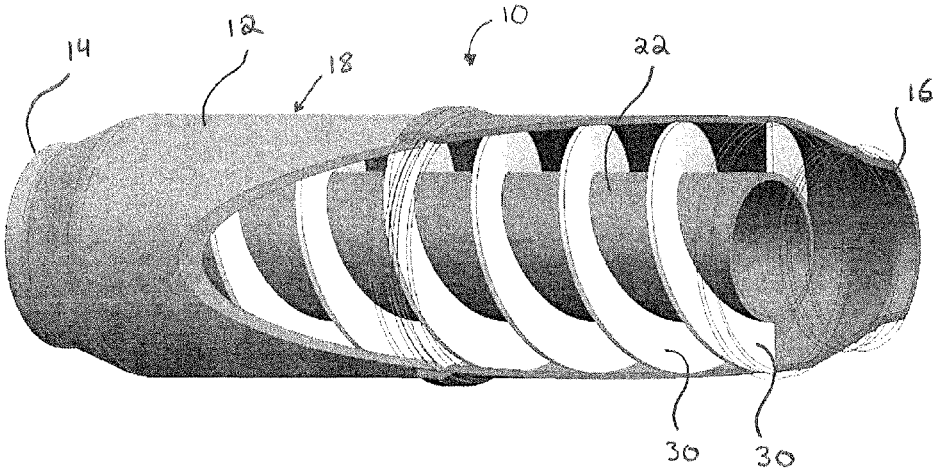
FIG. 4 illustrates a partial cut-away view of an embodiment of a split path silencer where the outer paths are defined by the inner tube, outer shell and two helical baffles.

In an embodiment illustrated in FIG. 4, the silencer 10 may include a plurality of baffles 30 to form a plurality of secondary paths. For example, the silencer 10 may include two or more spiral baffles 30 positioned about the inner tube 22. The spiral baffles 30 may be arranged to form two or more spiral paths. The spiral paths may be longer than the first path 28 through the inner tube. In an embodiment, each spiral path may be the same length.

The design of the silencer 10 may function to cancel out and attenuate sound waves that enter the silencer 10. This objective is accomplished by splitting the flow path of sound entering the silencer 10 into a first path 28 and a second path 32. The first path 28 may be shorter than the second path 32. For example, the first path 28 through the inner tube 22 is direct through the silencer 10 while the second path 32 around the baffle 30 spirals around the inner tube 22, thus making the first path 28 shorter than the second path 32. The two paths 28, 32 are arranged in parallel to allow sound waves to travel through the paths simultaneously. The sound waves then rejoin at the end of the two paths 28, 32. However, due to the difference in distance traveled between the two paths, the sound waves will be at different phases at the point where they recombine. This out of phase recombination results in partial wave cancelation at most frequencies and complete wave cancelation at the frequencies ($f_n$) expressed by the following equation:

$$f_n = c(n+1/2)/(l_2 - l_1) \quad \text{[Eq. 1]}$$

where c is the speed of sound, $l_2$ and $l_1$ are the lengths of the longer 32 and shorter 28 acoustic paths, respectively, and n=0, 1, 2, 3, etc.

This result is the fundamental equation driving the design of the silencer having a helical baffle. However, this is inadequate to fully describe the performance of a split path silencer. A split path silencer will also completely eliminate sound at the following frequencies ($f_m$):

$$f_m = cm/(l_2 + l_1) \quad \text{[Eq. 2]}$$

where m=1, 2, 3, 4, etc. Both $f_m$ and $f_n$ appear as peaks on a plot of sound transmission loss.

Figure 3:
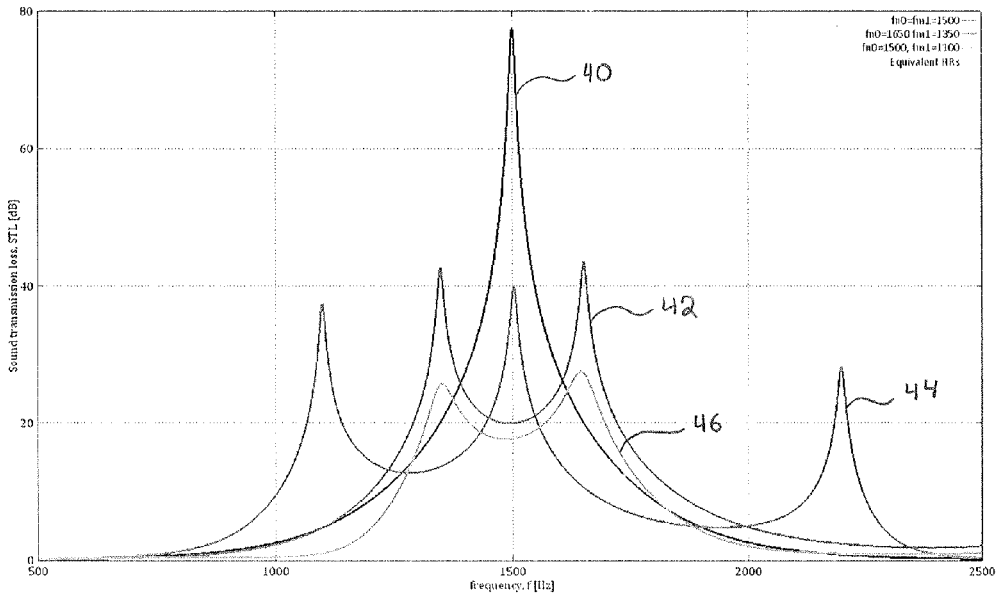
FIG. 3 illustrates a plot of four sound transmission curves over a set frequency range.

FIG. 3 illustrates four sound transmission loss curves over a frequency range of 500-2500 Hz. The first curve 40 is based on a design where the longer path is three times longer than the short path. At this length ratio the attenuation peak caused by the difference in path length ($f_{n0}$)is the same as the attenuation peak caused by the sum of path lengths ($f_{m1}$). This design is good for targeting a narrow frequency range.

The second curve 42 illustrates sound transmission loss when the longer path 32 is approximately 2.4 times longer than the short path 28. This design spreads the two fundamental peaks ($f_{m1} < f_{n0}$)apart in order to achieve good sound transmission loss (e.g., 20 dB) over a wider frequency range. In this example, an attenuation of at least 20 dB is achieved over a 46% larger frequency range compared to the first curve 40.

The third curve 44 illustrates a design where the longer path is approximately 2.15 times longer than the first path. This decrease in length ratio splits the two fundamental peaks ($f_{m1}$ and $f_{n0}$) so far apart that the sound transmission reduction potential of the split path silencer is diminished.

The forth curve 46 shows the performance of a pair of Helmholtz resonators tuned to the same frequencies as the fundamental peaks of the second curve 42, occupies the same total volume, and has the same total flow cross section. This design is inferior to the equivalent split path design 42 over all frequencies of interest.

In an embodiment, the silencer 10 may be configured to minimize the back pressure within the system. For example, the first and second openings 14, 16 may be sized to have an approximately equal cross-sectional area to each other, such as circular openings with equal diameters. The cross-sectional areas of the first path 28 and second path 32 may be sized in proportion to the cross-sectional areas of the first and second openings 14, 16. For example, the sum of the cross-sectional area of the first path 28 and the cross-sectional area of the second path 32 may be equal to the total cross sectional area of the first opening 14 or the second opening 16. In an embodiment having multiple baffles 30 to form multiple secondary paths, the sum of the first path 28 and all of the secondary paths may be equal to the area of the first opening 14 or the second opening 16.

In an embodiment, the cross-sectional area of the first path 28 may be equal to half of the cross sectional area of the first and second openings 14, 16. For example, the first and second openings 14, 16 may be circular having a first diameter. The inner tube 22 may be generally cylindrical having a constant diameter along its length. The diameter of the inner tube 22 may be sized such that the cross-sectional area of the first path 28 within the inner tube 22 is equal to half of the area of the first and second opening 14, 16.

The cross sectional area of at least a portion of the second flow path 32 may be equal to the cross-sectional area of the first flow path 28. The second flow path 32 may be defined by the path between the outer surface of the inner tube 22 and the inner surface of the outer shell 12 that is spirally wound around the inner tube 22. The spiral baffle 30 may form the sides of the second flow path 32. The cross-sectional area of the second flow path 32 may be defined as the area within the plane that is perpendicular to the baffle 30 and within the confines of the outer shell 12, inner tube 22, and the baffle 30. The cross-sectional area of the second flow path 32 may be equal to the cross sectional area of the first flow path 28, both of which are half the area of each of the first and second openings 14, 16.

In an embodiment having a plurality of baffles 30 and multiple secondary flow paths, the cross-section of each secondary flow path may be equal. It will be appreciated, however, that the cross-sections of the secondary flow paths may vary while still having the sum of the secondary path cross-sections and the first path cross-section equal to the area of the first opening 14 or second opening 16.

For certain applications it may be desirable to have a shorter, wider split path silencer e.g., packaging constraints. This can be achieved in two ways. One way is to redesign the split path silencer 10 such that the new $f_{m1}$ is the old $f_{n0}$ and the new $f_{n0}$ is the old $f_{m1}$. To ensure that the valley between the new $f_{m1}$ and $f_{n0}$ sound transmission loss peaks still achieves 20 dB of sound attenuation $l_2/l_1$ should be approximately 4.1. This yields a much shorter and wider split path resonator than one with similar sound transmission loss characteristics of interest and an $l_2/l_1$ ratio of 2.4.

A shorter and wider silencer can also be achieved by increasing the length of $l_1$ relative to the length of the inner tube by use of baffling within the inner tube. In an embodiment illustrated in FIGS. 5 and 6, the silencer 10 includes a helical baffle positioned within the inner tube 22 to create an acoustical path that is longer than the inner tube 22. If the flow areas of the first and second paths 32 and 28 are each equal to half of the inlet area 14, the split path silencer must be shorter and wider to target the values of $f_{n0}$ and $f_{m1}$.

Figure 5:
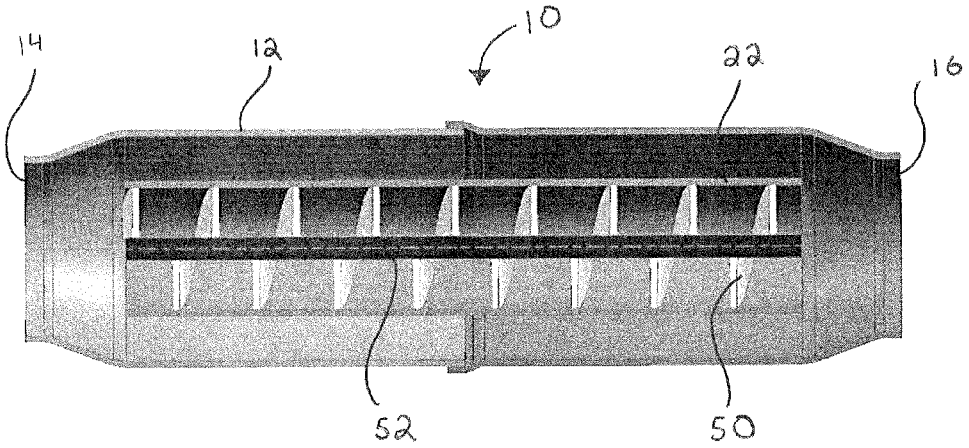
FIG. 5 illustrates a full cut-away of an embodiment of a split path silencer having a helical baffle positioned around a mandrel within the inner tube.

In an embodiment illustrated in FIG. 5, the silencer 10 may include a baffle 50 within the inner tube 22 and no baffle within the second flow path 32 around the outside of the inner tube 22. The baffle 50 may be positioned around a mandrel 52 that is located within the inner tube 22. The mandrel 52 may be centrally positioned within the inner tube 22. The silencer 10 may include one baffle 50 or a plurality of baffles 50 within the inner tube.

Figure 6:
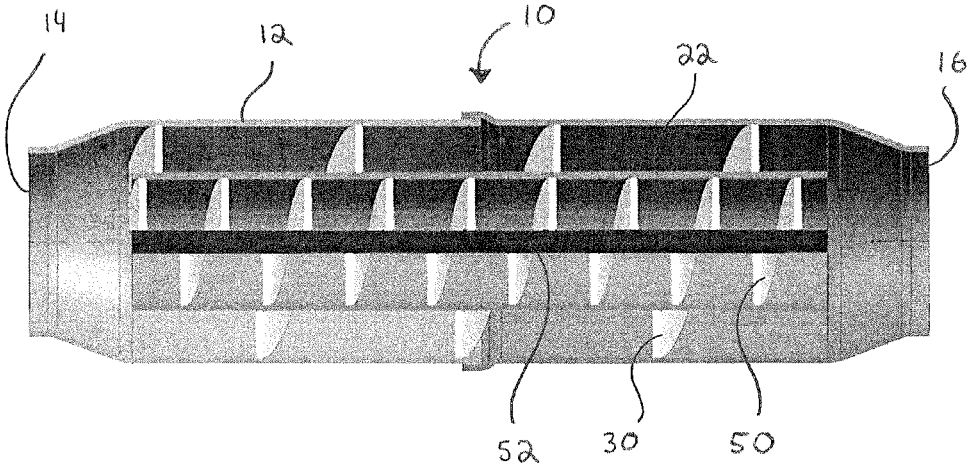
FIG. 6 illustrates a full cut-away of an embodiment of a split path silencer having a helical baffle positioned around a mandrel within the inner tube and a helical baffle positioned around the inner tube.

As illustrated in FIG. 6, the silencer 10 may include one or more baffles 50 positioned within the first flow path 28 and one or more baffles 30 positioned within the second flow path 32. The baffles 30, 50 may be arranged to make the first path 28 longer than the second path 32 or vice versa. The lengths of the flow paths with respect to one another may be tuned to any appropriate ratio, as described above. The sum of the cross sectional areas of all flow paths within the inner tube 22 and all flow paths between the inner tube 22 and the outer shell 12 may be equal to the area of the first or second openings 14, 16. Further, the sum of the cross sectional areas of all flow paths within the inner tube 22 may be equal to the sum of all flow paths between the inner tube 22 and the outer shell 12.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The claims as follows are intended to include all modifications and alterations insofar as they come within the scope of the claims or the equivalent thereof.

I claim:

1. A silencer comprising:

an outer shell having a first opening at a first end;

a tube positioned within the outer shell, the tube having a first end, a second end, and forming a first path therethrough;

a spiral baffle spirally wound around the inner tube and positioned between the inner tube and the outer shell and forming a second flow path therethrough, wherein the cross-sectional area of the second flow path is defined as the area of the plane perpendicular to the baffle and within the confines of the outer shell, inner tube, and the baffle; and wherein the sum of the cross-sectional areas of the first path and second path are equal to the cross-sectional area of the first opening.

2. The silencer of claim 1, wherein the cross-sectional area of the first path is equal to the cross-sectional area of the second path.

3. The silencer of claim 1, further comprising a second opening at a second end of the outer shell.

4. The silencer of claim 3, wherein the area of the second opening is equal to the area of the first opening.

5. The silencer of claim 1, wherein the first opening is connected to a pipe in an automotive exhaust system.

6. The silencer of claim 1, wherein the outer shell comprises an expanded section having a cross-sectional area that is greater than the area of the first opening.

7. The silencer of claim 1, wherein the tube has a circular cross-section.

8. The silencer of claim 7, wherein the tube has a constant diameter between the first and the second end.

9. The silencer of claim 1, wherein the cross-sectional area of the second path is the area within a plane that is perpendicular to the baffle and constrained by the outer shell, the tube, and the baffle.

10. The silencer of claim 1, wherein the outer shell comprises a first component and a second component.

11. The silencer of claim 1, wherein the first path is shorter than the second path.

12. The silencer of claim 1, wherein the second path is approximately 2.4 times longer than the first path.

13. The silencer of claim 1, wherein the second path is approximately 4.1 times longer than the first path.

14. The silencer of claim 1, wherein the tube is positioned concentric with the outer shell.

15. The silencer of claim 1, further comprising a second helical baffle positioned proximate to the first helical baffle.

16. The silencer of claim 15, wherein the helical baffle and second helical baffle form a second path and a third path.

17. The silencer of claim 15, wherein the length of the second path is equal to the length of the third path.

18. The silencer of claim 15, wherein the cross-sectional area of the second path is equal to the cross-sectional area of the third path.

19. A silencer comprising:

an outer shell having a first opening at a first end;

a tube positioned within the outer shell, the tube having a first end, a second end;

a first spiral baffle positioned within the inner tube and forming a first path therethrough, the first spiral baffle spirally wound around a mandrel positioned within the inner tube, wherein the cross-sectional area of the first path is defined as the area of the plane perpendicular to the baffle and within the confines of the inner tube, the mandrel, and the baffle;

a second path defined by the space between the inner tube and the outer shell; and wherein the sum of the cross-sectional areas of the first path and second path are equal to the cross-sectional area of the first opening.

20. The silencer of claim 19, further comprising a second baffle positioned between the inner tube and the outer shell and forming the second path.

21. The silencer of claim 20, wherein the first path is longer than the second path.

22. The silencer of claim 20, further comprising one or more additional helical baffles configured to create one or more additional inner or outer paths.

23. The silencer of claim 22, wherein the combined flow area of the inner paths is equal to the combined flow area of the outer paths.

24. The silencer of claim 19, wherein the first opening or second opening is connected to a second silencing device.

* * * * *